US008487854B2

(12) United States Patent
Liao et al.

(10) Patent No.: US 8,487,854 B2
(45) Date of Patent: Jul. 16, 2013

(54) LIQUID CRYSTAL DISPLAY DEVICE AND DRIVING METHOD THEREOF

(75) Inventors: Jhen-Shen Liao, Taoyuan County (TW); Kuan-Hung Liu, Taipei County (TW); Yi-Nan Chu, Changhua County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 702 days.

(21) Appl. No.: 12/345,688

(22) Filed: Dec. 30, 2008

(65) Prior Publication Data

US 2010/0020063 A1 Jan. 28, 2010

(30) Foreign Application Priority Data

Jul. 23, 2008 (TW) ..... 97127940 A

(51) Int. Cl.
*G09G 3/36* (2006.01)

(52) U.S. Cl.
USPC ..... 345/93

(58) Field of Classification Search
USPC ..... 345/87, 98, 90, 92–93
See application file for complete search history.

(56) References Cited

U.S. PATENT DOCUMENTS

| | | | | |
|---|---|---|---|---|
| 6,707,441 | B1 * | 3/2004 | Hebiguchi et al. | 345/92 |
| 7,023,419 | B2 * | 4/2006 | Park | 345/103 |
| 7,355,666 | B2 * | 4/2008 | Song et al. | 349/144 |
| 2001/0052888 | A1 * | 12/2001 | Hebiguchi | 345/87 |
| 2006/0197882 | A1 * | 9/2006 | Oh et al. | 349/43 |

FOREIGN PATENT DOCUMENTS

CN 1731503 A 2/2006

* cited by examiner

*Primary Examiner* — Chanh Nguyen
*Assistant Examiner* — Tsegaye Seyoum
(74) *Attorney, Agent, or Firm* — Winston Hsu; Scott Margo

(57) ABSTRACT

A method for driving a liquid crystal display (LCD) apparatus, wherein the LCD apparatus comprises a plurality of scan rows, a plurality of data columns, and a data driving circuit, includes: driving a plurality of specific scan rows of the plurality of scan rows at a same time; extracting a plurality of pixel data, arranged into a first order, corresponding to the plurality of specific scan rows; arranging the plurality of pixel data into a second order different from the first order according to a connecting relationship between the data driving circuit and a plurality of pixels of the plurality of specific scan rows; and utilizing the data driving circuit to drive a plurality of pixels according to the plurality of pixel data corresponding to the second order.

10 Claims, 5 Drawing Sheets

LIQUID CRYSTAL DISPLAY DEVICE AND DRIVING METHOD THEREOF

BACKGROUND OF THE INVENTION

1. Field of the Invention

The present invention relates to a method for driving a liquid crystal display apparatus, and more particularly to a method for driving a plurality of scan rows of the liquid crystal display apparatus at a same time.

2. Description of the Prior Art

Modern liquid crystal display apparatus usually employ techniques of color filters or a color sequential method to make pixels display specific colors. The color filter includes three colors: red, green and blue in a single pixel. A white light source is employed for penetrating each color filter of the pixel in the liquid crystal area with specific gray levels in order to display specific colors; this is known as color mixing in space. The color sequential method employs three color light sources: red, green and blue to penetrate a same liquid crystal area with a specific gray level at a different time in order to display specific colors. This is known as color mixing in time.

Compared with the color filter method, the color sequential method does not have to use color filters, thereby costs are lower than those of the color filter method and light transmittance is increased. However, a higher data write rate is required for the color sequential method. Suppose that a frame time of a pixel T0 includes a writing time T1 and a response time T2, and the color filters method writes pixel data corresponding to each sub-pixel of a single pixel (sub-pixels of a single pixel correspond to color filters of red, green and blue) into each sub-pixel within the writing time T1; the writing rate is (1/T1). The color sequential method writes pixel data corresponding to color filters of red, green and blue sequentially; the writing rate is (3/T1). A higher writing rate may result in an insufficient charging time for liquid crystals in the pixels, thereby lowering the display quality. Furthermore, a higher writing rate also causes higher power consumption.

SUMMARY OF THE INVENTION

It is therefore one objective of the present invention to provide a method for driving a liquid crystal display (LCD) apparatus, wherein the LCD apparatus comprises a plurality of scan rows, a plurality of data columns, and a data driving circuit. The method comprises: driving a plurality of specific scan rows of the plurality of scan rows at the same time; extracting a plurality of pixel data arranged into a first order corresponding to the plurality of specific scan rows; arranging the plurality of pixel data into a second order different from the first order according to a connecting relationship between the data driving circuit and a plurality of pixels of the plurality of specific scan rows; and utilizing the data driving circuit to drive a plurality of pixels according to the plurality of pixel data corresponding to the second order.

It is another objective of the present invention to provide an LCD apparatus. The LCD apparatus comprises: a plurality of scan rows, a plurality of data columns, a scan driving circuit, a data driving circuit, and a data ordering circuit. The scan driving circuit is employed for driving a plurality of specific scan rows of the plurality of scan rows. The data driving circuit is employed for driving the plurality of data columns. The data arrangement circuit is employed for extracting a plurality of pixel data arranged into a first order corresponding to the plurality of specific scan rows, and arranging the plurality of pixel data into a second order different from the first order according to a connecting relationship between the data driving circuit and a plurality of pixels of the plurality of specific scan rows, wherein the data driving circuit is employed for driving a plurality of pixels according to the plurality of pixel data corresponding to the second order.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
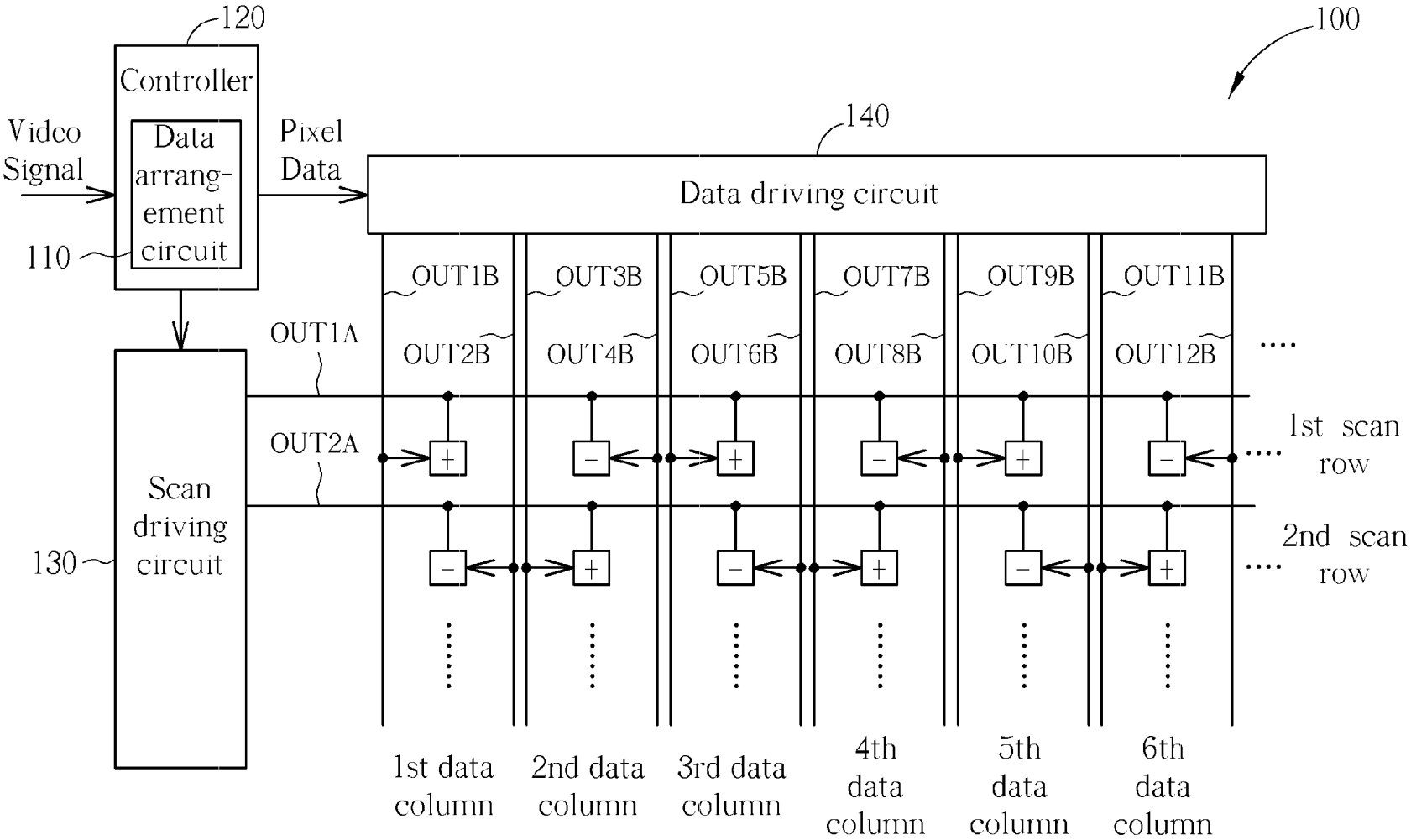
FIG. 1A is a diagram of an LCD apparatus according to one embodiment of the present invention.

FIG. 1A illustrates a diagram of an LCD apparatus 100 according to one embodiment of the present invention. The LCD apparatus 100 comprises (but is not limited to) a liquid crystal panel and a driving circuit. The driving circuit comprises a data arrangement circuit 110, a controller 120, a scan driving circuit 130 and a data driving circuit 140. The liquid crystal panel comprises: a plurality of scan rows (e.g. 1st and 2nd scan rows) and a plurality of data columns (e.g.1st~6th data columns), which intercross with each other on the liquid crystal panel. The controller 120 is employed for providing timing control signals and pixel data needed by the scan driving circuit 130 and the data driving circuit 140. The data driving circuit 140 drives the plurality of data columns according to the received pixel data. The data driving circuit 140 may be implemented with the conventional driving circuit. The scan driving circuit 130 is employed for driving a plurality of specific scan rows at a same time. The data arrangement circuit 110 is employed for rearranging the pixel data.

For carrying out multiple scan driving, each output terminal of the data driving circuit 140 and each pixel on the LCD apparatus 100 has a specific connecting relationship. In this embodiment, the $(4x+1)^{th}$ output terminal of the data driving circuit 140 is electrically connected to a pixel of the $(2z+1)^{th}$ data column on the $(2y+1)^{th}$ scan row; the $(4x+2)^{th}$ output terminal of the data driving circuit 140 is electrically connected to the pixel of the $(2z+1)^{th}$ data column on the $(2y+2)^{th}$ scan row; the $(4x+3)^{th}$ output terminal of the data driving circuit 140 is electrically connected to the pixel of the $(2z+2)^{th}$ data column on the $(2y+2)^{th}$ scan row; and the $(4x+4)^{th}$ output terminal of the data driving circuit 140 is electrically connected to the pixels of the $(2z+2)^{th}$ data column on the $(2y+1)^{th}$ scan row (x, y, z are all natural numbers). Each pixel has a reversed polarity against each neighboring pixel in order to alleviate flicker.

Please note that FIG. 1A only shows the 1st and the 2nd scan rows, the 1st to the 6th data columns, the 1st and the 2nd output terminals of the scan driving circuit 130 (OUT 1A~OUT 2A), and the 1st to the 12th output terminals of the data driving circuit 140 (OUT 1B~OUT 12B). However, there are no limitations in the numbers of scan rows, data columns, and output terminals in the present invention. Furthermore, FIG. 1A only shows components corresponding to the present invention.

Figure 2:
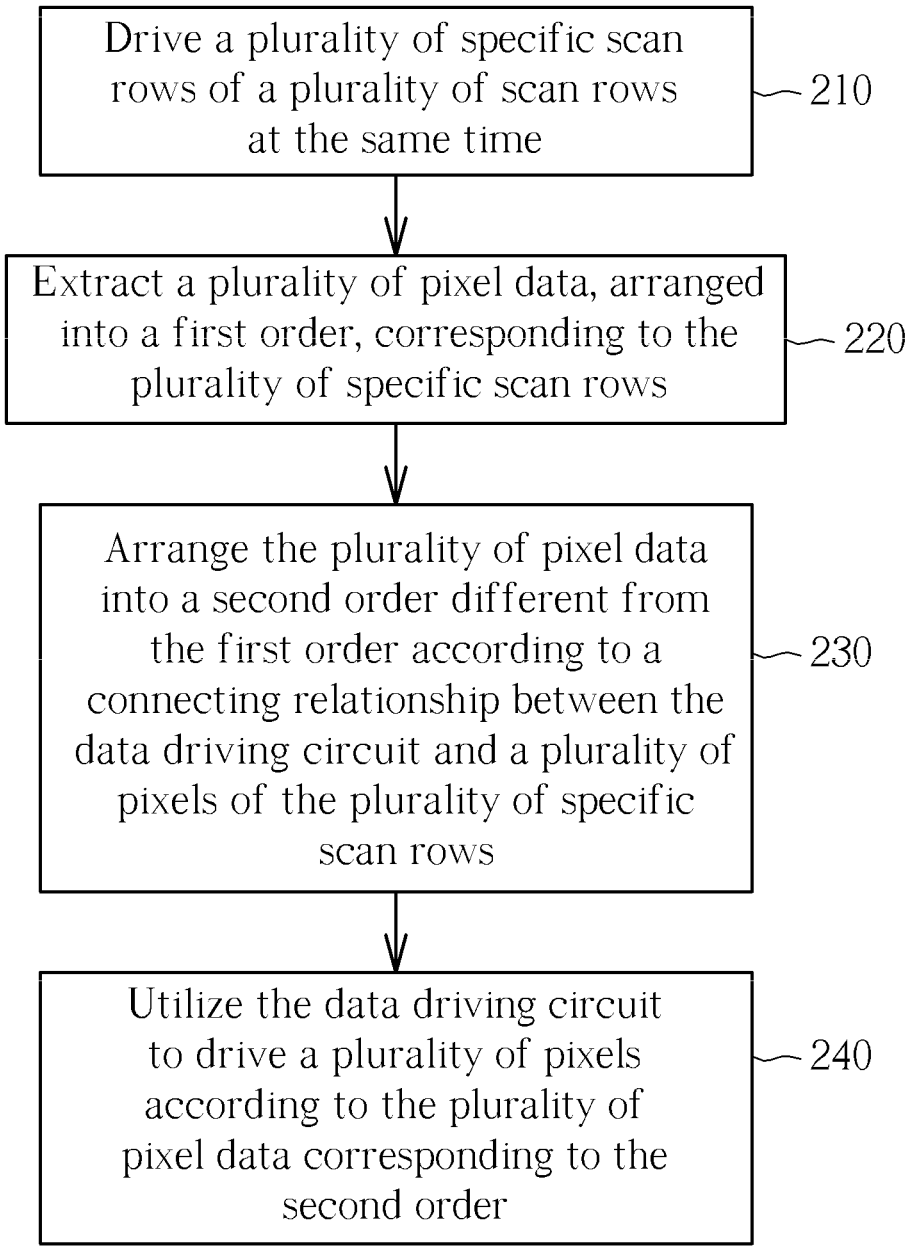
FIG. 2 is a flow chart of the method for driving an LCD apparatus according to one embodiment of the present invention.

FIG. 2 illustrates a flow chart of a method for driving the liquid crystal display apparatus of the present invention. The steps of the method according to an exemplary embodiment of the present invention are explained as follows.

Step 210: Drive a plurality of specific scan rows of a plurality of scan rows at the same time;

Step 220: Extract a plurality of pixel data, arranged into a first order, corresponding to the plurality of specific scan rows;

Step 230: Arrange the plurality of pixel data into a second order different from the first order according to a connecting relationship between the data driving circuit and a plurality of pixels of the plurality of specific scan rows;

Step 240: Utilize the data driving circuit to drive a plurality of pixels according to the plurality of pixel data corresponding to the second order.

Please note that, provided that the result is substantially the same, the steps mentioned above are not limited to be executed according to the exact order shown in FIG. 2, and need not be contiguous. That is, other steps can be intermediate or any of the said steps can be omitted or exchanged. Such modifications of the said steps in FIG. 2 therefore also fall within the scope of the present invention.

Figure 1B:
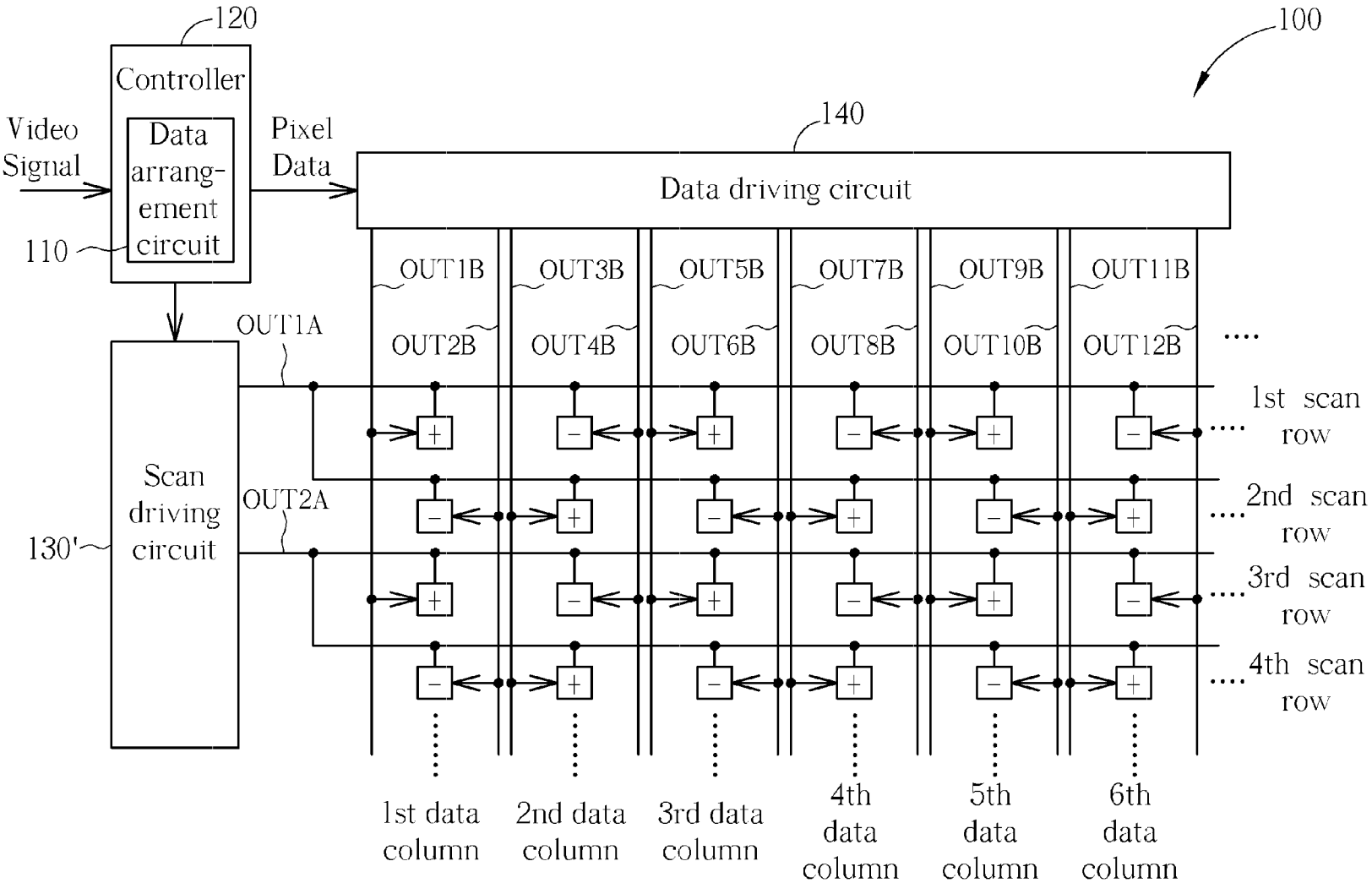
FIG. 1B is a diagram of an LCD apparatus according to another embodiment of the present invention.

Please refer to FIG. 1A and FIG. 2 simultaneously. The following description employs FIG. 1A to illustrate operations of the method for driving the LCD apparatus 100 of the present invention. The method for starts at 210, wherein the scan driving circuit 130 comprises a plurality of output terminals, electrically connected to a plurality of specific scan rows of the plurality of scan rows, and the scan driving circuit 130 is utilizing for driving the plurality of specific scan rows at the same time. For instance, the scan driving circuit 130 drives the 1st and the 2nd scan rows at the time same; however, this is not a limitation. The scan driving circuit 130 is also able to drive three or more scan rows at the same time. FIG. 1B illustrates a diagram of the LCD apparatus 100 according to another embodiment of the present invention. Please refer to FIG. 1B, wherein components in FIG. 1A and FIG. 1B labeled with the same numbers have the same or similar functions. Thus, detailed descriptions of FIG. 1B are omitted here for the sake of brevity.

One output terminal of the scan driving circuit 130' shown in FIG. 1B is also able to drive a plurality of specific scan rows at the same time. For instance, the output terminal OUT1A of the scan driving circuit 130' drives the 1st and the 2nd scan rows at the same time while the output terminal OUT2A of the scan driving circuit 130' drives the 3rd and the 4th scan rows at the same time. Additionally, output terminals of the scan driving circuit 130' are also able to drive more than two scan rows.

Figure 3:
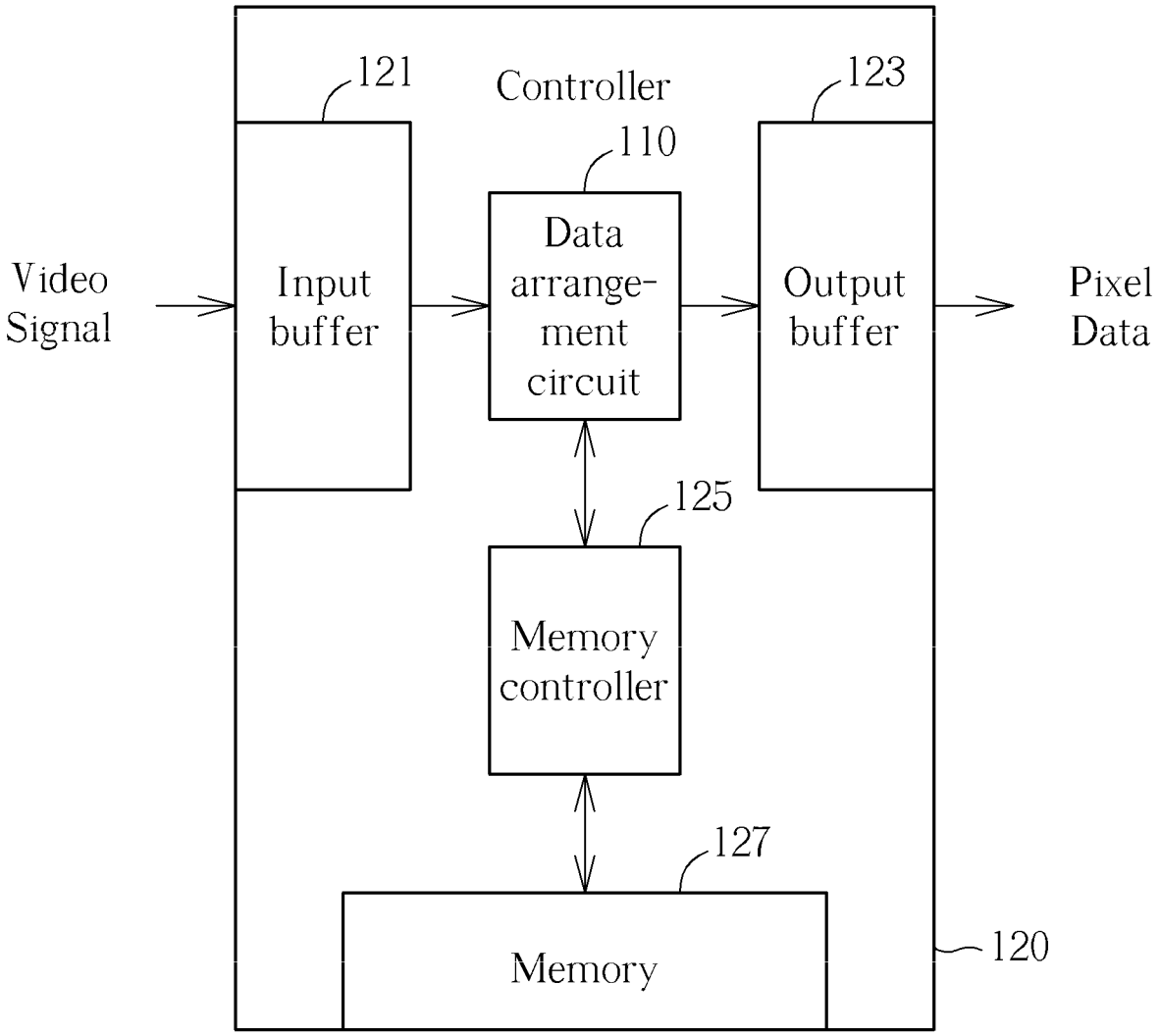
FIG. 3 is a block diagram of the controller shown in FIG. 1A according to one embodiment of the present invention.

Accordingly, the data arrangement circuit 110 is utilized for extracting a plurality of pixel data, arranged into the first order, corresponding to the plurality of specific scan rows in accordance with Step 220. In this embodiment, the 1st and the 2nd scan rows are driven by the scan driving circuit 130 at the same time so that the data arrangement circuit 110 needs to extract the plurality of pixel data corresponding to the 1st and the 2nd scan rows. These pixel data are obtained from video signals provided by a video system side (not shown in FIG. 1A). Arrangement and formats of the video signal depends on the video system side. For example, the video system side may output pixel data regarding three sub-pixels of Red, Green and Blue of the single pixel at the same time within one clock cycle, namely, parallel RGB signals. FIG. 3 illustrates a block diagram of the controller shown in FIG. 1A according to one embodiment of the present invention. The controller 120 comprises a buffer 121, a data arrangement circuit 110, a memory controller 125, an output buffer 123, and a memory 127. Via the output buffer 123, the data arrangement circuit 110 extracts the parallel RGB signals provided by the system side. The parallel RGB signals are stored into the memory 127 under the control of the memory controller 125. For instance, when the memory 127 has stored all the pixel data of the 1st and the 2nd scan rows, the data arrangement circuit 110 extracts the pixel data arranged into a specific order (e.g. the parallel RGB signals in a first order) in the memory 127 through the memory controller 125. Please note that the data arrangement circuit 110 is also able to extract these pixel data when the memory 127 stores the last part of pixel data before the 1stand 2nd scan rows.

Next, referring to Step 230, the data arrangement circuit 110 arranges a plurality of pixel data into a second order different from the first order according to the connecting relationship between the data driving circuit 140 and a plurality of pixels on the plurality of specific scan rows. In this embodiment, the data arrangement circuit 110 rearranges the plurality of pixel data arranged into the first order as a second order according to the connecting relationship between the data driving circuit 140 and the plurality of pixels on the 1st and the 2nd scan rows. For example, rearranging the parallel RGB signals makes the Red pixel data of the first data column on the first scan row, the Red pixel data of the first data column on the second scan row, and the Red pixel data of the second data column on the second scan row placed at the first priority and makes the Red pixel data of the second data column on the first scan row, the Red pixel data of the third data column on the first scan row, and the Red pixel data of the third data column on the second scan row placed at the second priority.

In accordance with Step 240, the data driving circuit 140 drives a plurality of pixels according to the plurality of pixel data arranged into the second order. For example, in this embodiment, the controller 120 sequentially inputs at least one pixel data of the plurality of pixel data corresponding to the second order to the data driving circuit 140. For instance, in the first clock cycle, a pixel data corresponding to a $(6n+1)^{th}$ data column on the $(2m+1)^{th}$ scan row, a pixel data corresponding to the $(6n+1)^{th}$ data column on the $(2m+2)^{th}$ scan row, and a pixel data corresponding to a $(6n+2)^{th}$ data column on the $(2m+2)^{th}$ scan row are respectively input to the data driving circuit 140 at the same time. In the second clock cycle, a pixel data corresponding to the $(6n+2)^{th}$ data column on the $(2m+1)^{th}$ scan row, a pixel data corresponding to the $(6n+3)^{th}$ data column on the $(2m+1)^{th}$ scan row, and a pixel data corresponding to a $(6n+3)^{th}$ data column on the $(2m+2)^{th}$ scan row are respectively input to the data driving circuit 140 at the same time. In the third clock cycle, a pixel data corresponding to a $(6n+4)^{th}$ data column on the $(2m+2)^{th}$ scan row, a pixel data corresponding to the $(6n+4)^{th}$ data column on the $(2m+1)^{th}$ scan row, and a pixel data corresponding to a $(6n+5)^{th}$ data column on the $(2m+1)^{th}$ scan row are respectively input to the data driving circuit 140 at the same time. Finally, in the fourth clock cycle, a pixel data corresponding to a $(6n+5)^{th}$ data column on the $(2m+2)^{th}$ scan row, a pixel data corresponding to a $(6n+6)^{th}$ data column on the $(2m+2)^{th}$ scan row, and a pixel data corresponding to the $(6n+6)^{th}$ data column on the $(2m+1)^{th}$ scan row are respectively input to the data driving circuit 140 at the same time, wherein m and n are both natural numbers. After all pixel data of the 1st and the 2nd scan rows are input to the data driving circuit 140, according to each pixel data, the data driving circuit 140 drives each corresponding pixel of the 1st and the 2nd scan rows.

Figure 4:
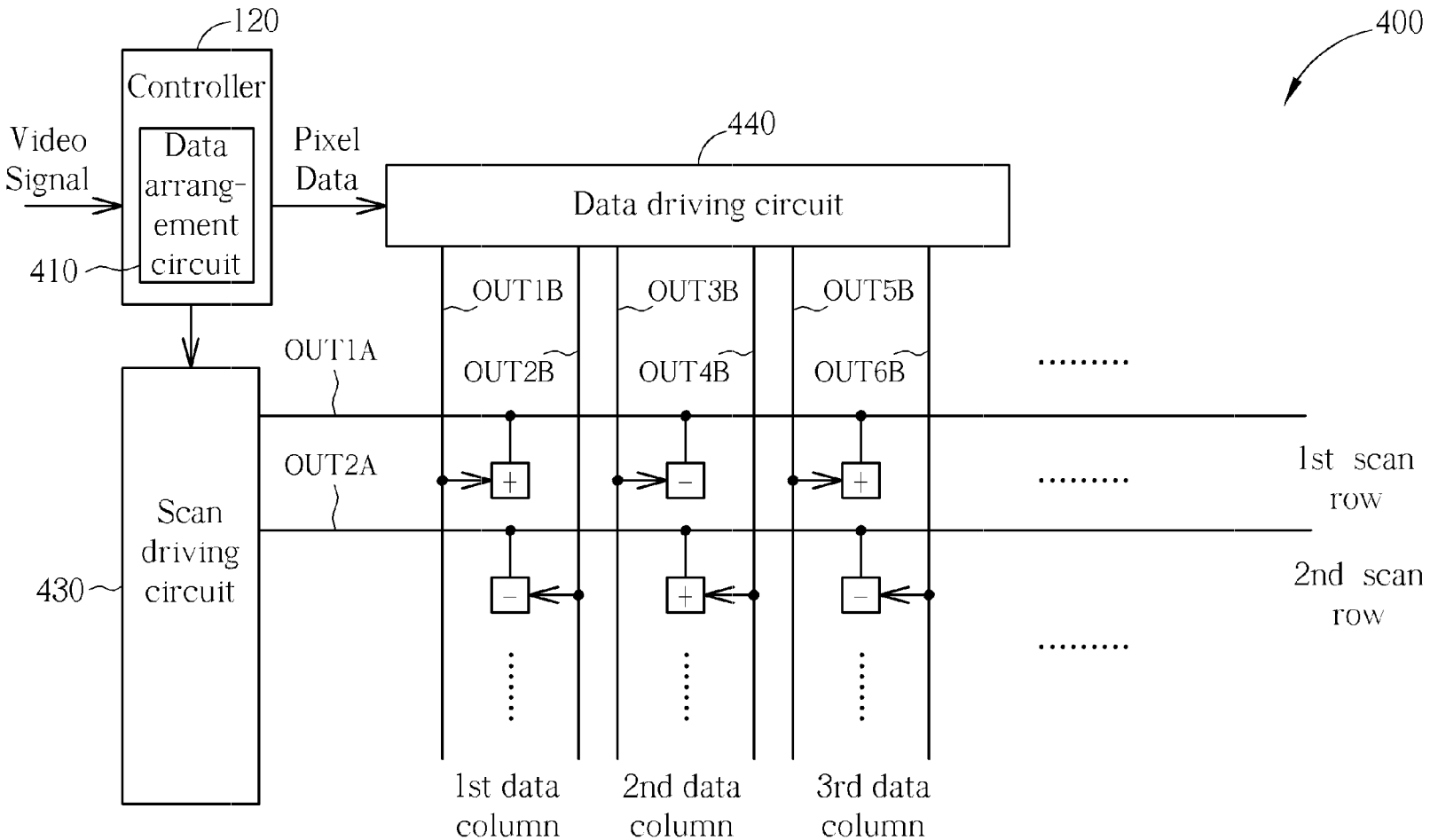
FIG. 4 is a diagram of an LCD apparatus according to another embodiment of the present invention.

FIG. 4 illustrates a diagram of the LCD apparatus 400 according to another embodiment of the present invention. The LCD apparatus comprises (but is not limited to): a driving circuit; and a liquid crystal panel, wherein the driving circuit comprises: a data arrangement circuit 410; a controller 420; a scan driving circuit 430; and a data driving circuit 440. The liquid crystal panel includes a plurality of scan rows (e.g. the 1st and the 2nd scan rows) and a plurality of data columns (e.g. the 1st to the 3rd data columns), which are intercrossed with each other on the liquid crystal panel. Each circuit component of the LCD apparatus 400 has a similar function with the corresponding circuit component of the LCD apparatus 100, so detailed descriptions are omitted here for the sake of brevity. The primary difference between the LCD apparatus 100 shown in FIG. 1A and the LCD apparatus 400 shown in FIG. 4 is the connecting relationship between the data driving circuit and a plurality of pixels of a plurality of scan rows. Thus, the LCD apparatus 400 achieves the objective of multiple scan driving in according with the steps shown in FIG. 2. Related operations are explained as follows.

For carrying out multiple scan driving, each output terminal of the data driving circuit 440 and each pixel on the LCD apparatus 400 has a specific connecting relationship. In this embodiment, a $(2x+1)^{th}$ output terminal of the data driving circuit 440 is electrically connected to a pixel of a $(2z+1)^{th}$ data column on the $(2y+1)^{th}$ scan row; and a $(2x+2)^{th}$ output terminal of the data driving circuit 440 is electrically connected to the pixel of the $(2z+1)^{th}$ data column on the $(2y+2)^{th}$ scan row (x, y, z are both natural numbers). Please note that FIG. 4 only shows the 1st and the 2nd scan rows, the 1st to the 3rd data columns, the 1st and the 2nd output terminals of the scan driving circuit 430 (OUT 1A~OUT 2A), and the 1st to the 6th output terminals of the data driving circuit 440 (OUT 1B~OUT 6B); however, there are no limitations in the numbers of scan rows, data columns, and output terminals in the present invention. Furthermore, FIG. 4 only shows components corresponding to the present invention.

The scan driving circuit 430 comprises a plurality of output terminals, electrically connected to a plurality of specific scan rows of the plurality of scan rows, and the scan driving circuit 430 is utilizing for driving the plurality of specific scan rows at the same time. For instance, the scan driving circuit 430 drives the 1st and the 2nd scan rows at the time same; however, this is not a limitation.

In this embodiment, the 1st and the 2nd scan rows are driven by the scan driving circuit 430 at the same time so that the data arrangement circuit 410 needs to extract the plurality of pixel data corresponding to the 1st and the 2nd scan rows. These pixel data are obtained from video signals arranged into a first order provided by a video system side (not shown in FIG. 4). In this embodiment, the video system side outputs pixel data regarding three sub-pixels of red, green and blue of a single pixel at the same time within one clock cycle; namely, parallel RGB signals.

In this embodiment, the data arrangement circuit 410 rearranges the plurality of pixel data arranged into the first order as a second order according to the connecting relationship between the data driving circuit 440 and a plurality of pixels on the 1st and the 2nd scan rows. For example, rearranging the parallel RGB signals makes the Red pixel data of the first data column on the first scan row, the Red pixel data of the first data column on the second scan row, and the Red pixel data of the second data column on the first scan row placed at the first priority; and makes the Red pixel data of the second data column on the second scan row, the Red pixel data of the third data column on the first scan row, and the Red pixel data of the third data column on the second scan row placed at the second priority.

The data driving circuit 440 drives a plurality of pixels according to the plurality of pixel data arranged into the second order. For example, in this embodiment, the controller 420 sequentially inputs at lease one pixel data of the plurality of pixel data corresponding to the second order to the data driving circuit 440. For instance, in the first clock cycle, the pixel data corresponding to the $(3n+1)^{th}$ data column on the $(2m+1)^{th}$ scan row, the pixel data corresponding to the $(3n+1)^{th}$ data column of the $(2m+2)^{th}$ scan row, and the pixel data corresponding to the $(3n+2)^{th}$ data column on the $(2m+1)^{th}$ scan row are respectively input to the data driving circuit 440 at the same time. In the second clock cycle, the pixel data corresponding to the $(3n+2)^{th}$ data column on the $(2m+2)^{th}$ scan row, a pixel data corresponding to the $(3n+3)^{th}$ data column on the $(2m+1)^{th}$ scan row, and a pixel data corresponding to the $(3n+3)^{th}$ data column on the $(2m+2)^{th}$ scan row are respectively input to the data driving circuit 440 at the same time, wherein m and n are both natural numbers. After all pixel data of the 1st and the 2nd scan rows are input to the data driving circuit 440, according to each pixel data, the data driving circuit 440 drives each corresponding pixel of the 1st and the 2nd scan rows To sum up, employing the method and the apparatus of the present invention rearranges the conventional video signals. Combined with the conventional data driving circuit, multiple scan driving can therefore be carried out. Hence, the present invention enables the conventional LCD apparatus to have low power consumption, a preferred display quality and reduced manufacturing costs by means of this multiple scan driving, without requiring huge modifications.

Those skilled in the art will readily observe that numerous modifications and alterations of the device and method may be made while retaining the teachings of the invention.

What is claimed is:

1. A method for driving a liquid crystal display (LCD) apparatus, the LCD apparatus comprising a liquid crystal panel and a driving circuit, a plurality of scan rows and a plurality of data columns intercrossing with each other on the liquid crystal panel, the driving circuit comprising a data driving circuit, wherein the method comprises:

driving a plurality of specific scan rows of the plurality of scan rows at a same time;

extracting a plurality of pixel data, arranged into a first order, corresponding to the plurality of specific scan rows;

arranging the plurality of pixel data into a second order different from the first order according to a connecting relationship between the data driving circuit and a plurality of pixels of the plurality of specific scan rows; and utilizing the data driving circuit to drive the plurality of pixels according to the plurality of pixel data corresponding to the second order;

wherein at least one pixel data on a first specific scan row, arranged in the second order, is arranged between a plurality of pixel data on a second specific scan row; the plurality of specific scan rows comprises a $(2m+1)^{th}$ scan row and a $(2m+2)^{th}$ scan row, and the step of sequentially inputting at least one pixel data of the plurality of pixel data corresponding to the second order to the data driving circuit comprises:

a pixel data corresponding to a $(6n+1)^{th}$ data column on the $(2m+1)^{th}$ scan row, a pixel data corresponding to the $(6n+1)^{th}$ data column on the $(2m+2)^{th}$ scan row, and a pixel data corresponding to a $(6n+2)^{th}$ data column on the $(2m+2)^{th}$ scan row are respectively input to the data driving circuit at a same time;

a pixel data corresponding to the $(6n+2)^{th}$ data column on the $(2m+1)^{th}$ scan row, a pixel data corresponding to a $(6n+3)^{th}$ data column on the $(2m+1)^{th}$ scan row, and a pixel data corresponding to the $(6n+3)^{th}$ data column on the $(2m+2)^{th}$ scan row are respectively input to the data driving circuit at a same time;

a pixel data corresponding to a $(6n+4)^{th}$ data column on the $(2m+2)^{th}$ scan row, a pixel data corresponding to the $(6n+4)^{th}$ data column on the $(2m+1)^{th}$ scan row, and a pixel data corresponding to a $(6n+5)^{th}$ data column on the $(2m+1)^{th}$ scan row are respectively input to the data driving circuit at a same time; and a pixel data corresponding to the $(6n+5)^{th}$ data column on the $(2m+2)^{th}$ scan row, a pixel data corresponding to a $(6n+6)^{th}$ data column on the $(2m+2)^{th}$ scan row, and a pixel data corresponding to the $(6n+6)^{th}$ data column on the $(2m+1)^{th}$ scan row are respectively input to the data driving circuit at a same time;

wherein, on the $(2m+1)^{th}$ scan row, the $(6n+3)^{th}$ data column is a next data line adjacent to the $(6n+2)^{th}$ data column, the $(6n+5)^{th}$ data column is a next data line adjacent to the $(6n+4)^{th}$ data column; and, on the $(2m+2)^{th}$ scan row, the $(6n+2)^{th}$ data column is a next data line adjacent to the $(6n+1)^{th}$ data column, the $(6n+4)^{th}$ data column is a next data line adjacent to the $(6n+3)^{th}$ data column, and the $(6n+6)^{th}$ data column is a next data line adjacent to the $(6n+5)^{th}$ data column.

2. The method of claim 1, wherein the connecting relationship comprises:

a $(4x+1)^{th}$ output terminal of the data driving circuit electrically connected to a pixel of a $(2z+1)^{th}$ data column on a $(2y+1)^{th}$ scan row;

a $(4x+2)^{th}$ output terminal of the data driving circuit electrically connected to a pixel of a $(2z+1)^{th}$ data column on a $(2y+2)^{th}$ scan row;

a $(4x+3)^{th}$ output terminal of the data driving circuit electrically connected to a pixel of a $(2z+2)^{th}$ data column on the $(2y+2)^{th}$ scan row; and a $(4x+4)^{th}$ output terminal of the data driving circuit electrically connected to a pixel of a $(2z+2)^{th}$ data column on the $(2y+1)^{th}$ scan row.

3. The method of claim 2, wherein the step of utilizing the data driving circuit to drive the plurality of pixels according to the plurality of pixel data corresponding to the second order comprises:

sequentially inputting at least one pixel data of the plurality of pixel data corresponding to the second order to the data driving circuit; and according to each pixel data, utilizing the data driving circuit to drive each corresponding pixel on the plurality of specific scan rows.

4. The method of claim 1, wherein each pixel of the plurality of pixels has a reversed polarity against each neighboring pixel.

5. The method of claim 1, wherein the driving circuit further comprises a scan driving circuit, which includes a plurality of output terminals electrically connected to the plurality of specific scan rows.

6. A liquid crystal display (LCD) apparatus, comprising:

a liquid crystal panel, comprising:

a plurality of scan rows; and a plurality of data columns, wherein the plurality of scan rows and the plurality of data columns are intercrossed with each other on the liquid crystal panel; and a driving circuit, comprising:

a scan driving circuit, for driving a plurality of specific scan rows of the plurality of scan rows;

a data driving circuit, for driving the plurality of data columns; and a data arrangement circuit, for extracting a plurality of pixel data, arranged into a first order, corresponding to the plurality of specific scan rows and arranging the plurality of pixel data into a second order different from the first order according to a connecting relationship between the data driving circuit and a plurality of pixels of the plurality of specific scan rows, wherein the data driving circuit drives the plurality of pixels according to the plurality of pixel data corresponding to the second order; and wherein at least one pixel data on a first specific scan row, arranged in the second order, is arranged between a plurality of pixel data on a second specific scan row; the plurality of the specific scan rows comprises a $(2m+1)^{th}$ scan row and a $(2m+2)^{th}$ scan row, and in the plurality of pixel data corresponding to the second order, a pixel data corresponding to a $(6n+1)^{th}$ data column on the $(2m+1)^{th}$ scan row, a pixel data corresponding to the $(6n+1)^{th}$ data column on the $(2m+2)^{th}$ scan row, and a pixel data corresponding to a $(6n+2)^{th}$ data column on the $(2m+2)^{th}$ scan row are respectively input to the data driving circuit at a same time; then, in the plurality of pixel data corresponding to the second order, a pixel data corresponding to the $(6n+2)^{th}$ data column on the $(2m+1)^{th}$ scan row, a pixel data corresponding to a $(6n+3)^{th}$ data column on the $(2m+1)^{th}$ scan row, and a pixel data corresponding to the $(6n+3)^{th}$ data column on the $(2m+2)^{th}$ scan row are respectively input to the data driving circuit at the same time; then, in the plurality of pixel data corresponding to the second order, a pixel data corresponding to a $(6n+4)^{th}$ data column on the $(2m+2)^{th}$ scan row, a pixel data corresponding to the $(6n+4)^{th}$ data column on the $(2m+1)^{th}$ scan row, and a pixel data corresponding to a $(6n+5)^{th}$ data column on the $(2m+1)^{th}$ scan row are respectively input to the data driving circuit at a same time; then, in the plurality of pixel data corresponding to the second order, a pixel data corresponding to the $(6n+5)^{th}$ data column on the $(2m+2)^{th}$ scan row, a pixel data corresponding to a $(6n+6)^{th}$ data column on the $(2m+2)^{th}$ scan row, and a pixel data corresponding to the $(6n+6)^{th}$ data column on the $(2m+1)^{th}$ scan row are respectively input to the data driving circuit at a same time wherein, on the $(2m+1)^{th}$ scan row, the $(6n+3)^{th}$ data column is a next data line adjacent to the $(6n+2)^{th}$ data column, the $(6n+5)^{th}$ data column is a next data line adjacent to the $(6n+4)^{th}$ data column; and, on the $(2m+2)^{th}$ scan row, the $(6n+2)^{th}$ data column is a next data line adjacent to the $(6n+1)^{th}$ data column, the $(6n+4)^{th}$ data column is a next data line adjacent to the $(6n+3)^{th}$ data column, and the $(6n+6)^{th}$ data column is a next data line adjacent to the $(6n+5)^{th}$ data column.

7. The LCD apparatus of the claim 6, wherein the connecting relationship comprises:

a $(4x+1)^{th}$ output terminal of the data driving circuit electrically connected to a pixel of a $(2z+1)^{th}$ data column on a $(2y+1)^{th}$ scan row;

a $(4x+2)^{th}$ output terminal of the data driving circuit electrically connected to a pixel of a $(2z+1)^{th}$ data column on a $(2y+2)^{th}$ scan row;

a $(4x+3)^{th}$ output terminal of the data driving circuit electrically connected to a pixel of a $(2z+2)^{th}$ data column on the $(2y+2)^{th}$ scan row; and a $(4x+4)^{th}$ output terminal of the data driving circuit electrically connected to a pixel of a $(2z+2)^{th}$ data column on the $(2y+1)^{th}$ scan row.

8. The LCD apparatus of claim 7, wherein at least one pixel data of the plurality of pixel data corresponding to the second order is sequentially input to the data driving circuit, and according to each pixel data, the data driving circuit drives each corresponding pixel on the plurality of specific scan rows.

9. The LCD apparatus of claim 6, wherein each pixel of the plurality of pixels has a reversed polarity against each neighboring pixel.

10. The LCD apparatus of claim 6, wherein the scan driving circuit comprises a plurality of output terminals electrically connected to the plurality of specific scan rows.

* * * * *